US010160125B1

(12) United States Patent
Skye

(10) Patent No.: US 10,160,125 B1
(45) Date of Patent: Dec. 25, 2018

(54) BLADE PROTECTOR FOR A CLIPPER

(71) Applicant: Maiya N. Skye, Washington, DC (US)

(72) Inventor: Maiya N. Skye, Washington, DC (US)

( * ) Notice: Subject to any disclaimer, the term of this patent is extended or adjusted under 35 U.S.C. 154(b) by 0 days.

(21) Appl. No.: 15/229,201

(22) Filed: Aug. 5, 2016

Related U.S. Application Data

(60) Provisional application No. 62/205,493, filed on Aug. 14, 2015.

(51) Int. Cl.
*B26B 13/00* (2006.01)
*B26B 19/38* (2006.01)

(52) U.S. Cl.
CPC ..... *B26B 19/3833* (2013.01); *B26B 19/3813* (2013.01)

(58) Field of Classification Search
CPC ..... B26B 19/20; B26B 19/3813; B26B 19/22; B26B 19/10; B26B 19/02; B26B 19/04; B26B 19/3846; B26B 19/3853; B26B 19/06
USPC ..... 30/233, 133, 200, 286, 195, 223, 201, 30/233.5, 155, 224, 225, 208; D28/49–54
See application file for complete search history.

(56) References Cited

U.S. PATENT DOCUMENTS 1,621,641 A 3/1927 Redman
2,608,756 A * 9/1952 Jepson ..... B26B 19/20 30/286
2,662,719 A 12/1953 Hammond
3,344,520 A * 10/1967 Williams ..... B26B 19/20 30/133
D210,713 S * 4/1968 Hamill ..... 30/539
D221,501 S 8/1971 Seiffert
3,667,122 A * 6/1972 Black ..... B26B 29/02 30/286
4,622,745 A * 11/1986 Wahl ..... B26B 19/20 30/201
D407,531 S * 3/1999 Lee ..... D28/47
6,076,263 A 6/2000 Andis et al.
7,004,785 B2 * 2/2006 Melton ..... B26B 19/3833 242/405.1
7,188,422 B2 * 3/2007 McCambridge ..... B26B 19/06 30/122
7,485,126 B2 * 2/2009 Adelman ..... A61B 17/3213 30/155
8,136,253 B2 * 3/2012 Zoot ..... B26B 19/22 30/195
8,826,922 B1 9/2014 Lewis
D776,349 S 1/2017 Skye
D785,249 S * 4/2017 Torres ..... D28/54
2004/0250428 A1 * 12/2004 Melton ..... B26B 19/20 30/200
2004/0250429 A1 * 12/2004 McCambridge ..... B26B 19/20 30/233.5
2009/0019706 A1 * 1/2009 Werner ..... B26B 19/3813 30/233.5
2009/0113722 A1 * 5/2009 Werner ..... B26B 19/3813 30/200
2009/0172957 A1 * 7/2009 Prudden, Jr. ..... B26B 21/4037 30/539

(Continued)

*Primary Examiner* — Ghassem Alie
(74) *Attorney, Agent, or Firm* — Cahn & Samuels, LLP

(57) ABSTRACT

A blade protector includes a bottom portion having a fastening mechanism for securing the blade protector onto at least one part of a clipper; and an enclosure on a side of the blade protector and extending from a top portion thereof configured to cover an edge of the clipper.

9 Claims, 4 Drawing Sheets

(56) References Cited

U.S. PATENT DOCUMENTS

| | | | | |
|---|---|---|---|---|
| 2010/0317938 | A1* | 12/2010 | Kuhn | A61B 5/0084 600/323 |
| 2012/0110859 | A1* | 5/2012 | Kammer | B26B 19/06 30/223 |
| 2013/0192068 | A1 | 8/2013 | Kammer et al. | |
| 2013/0219724 | A1* | 8/2013 | Werner | B26B 19/06 30/201 |
| 2014/0352158 | A1* | 12/2014 | McCambridge | B26B 19/06 30/200 |
| 2015/0251325 | A1 | 9/2015 | Teteak et al. | |

* cited by examiner

BLADE PROTECTOR FOR A CLIPPER

This application claims priority to U.S. Ser. No. 62/205,493 filed in the U.S. Patent and Trademark Office on Aug. 14, 2015, the entirety of which is incorporated herein by reference.

FIELD OF THE INVENTION

This invention relates to barber equipment and more particularly to a blade protector that assists in protecting a clipper, particularly a hair clipper blade.

BACKGROUND OF THE INVENTION

Hair clippers are specialized implements used to cut hair. Hair clippers work on the same principle as scissors. Hair clippers generally comprise a plurality of sharpened comb-like teeth or blades in close contact that slide relative to each other. Hair clippers generally have a handle and a mechanism, which may be manual or electrical, to make the blades oscillate from side to side. The hair clipper may be moved or automated by an electric motor so that hair is positioned between the blades and cut with a scissor action when one blade slides sideways relative to another.

It is a frequent source of frustration for barbers, stylists, and individual owners to protect a hair clipper blade, particularly while transporting, traveling, or storing the hair clipper. While transporting, it is a standard custom to wrap hair clippers in either the power cord itself or some sort of soft cloth material. These arrangements offer negligible protection and can still damage the blades or the hair clipper itself. Damage may result from impact with other objects or even inadvertent dropping of the hair clipper. Damage to the hair clipper can also result from blade exposure to moisture. Prolonged exposure to moisture may result in rust and/or other water-related damage.

Damage to a hair clipper, aside from inconvenience to the barber or stylist, can cause significant repair expense. The clipper blades tend to be fragile and also the most expensive part to repair. Therefore, a need exists for an apparatus that can limit potential damage to a hair clipper and protect the hair clipper blades.

All mechanical and manual clippers require specific and unique adjustment or alignment of the stationary and/or cutting blades in order to perform an even haircut and to protect a person from being injured. If the alignment becomes offset and the cutting blade moves above the stationary blade, a person receiving service with that clipper blade can experience injury to the area being trimmed, cut, or shaved by the hair clipper. Thus, there is also a need for an apparatus that helps maintain a clipper blade setting and alignment in order to help prevent injury.

SUMMARY OF THE INVENTION

A blade protector according to an embodiment of the present invention comprises a fastening mechanism for securing the blade protector onto at least one part of a clipper; and an enclosure on a side of the blade protector and extending from a top portion thereof configured to cover an edge of the clipper.

According to one embodiment of the present invention, a blade protector comprises a body comprising a material selected from the group consisting of plastic, metal, ceramic, cloth, foam, wood, and any combination thereof. The body includes a bottom surface comprising 1) a fastening mechanism for securing the blade protector onto at least one part of a hair clipper; 2) at least one magnet; and 3) at least one recessed portion configured to receive at least one protruding member of the hair clipper; and a top surface comprising at least one protrusion corresponding to the at least one recessed potion. The blade protector also comprises an enclosure at a first end of the blade protector configured to cover an edge of the hair clipper and a finger tab at a second end of the blade protector.

According to another embodiment, the present invention is directed to a kit comprising a clipper having a plurality of blades and a blade protector.

An object of the present invention is to provide a blade protector for a hair clipper which is designed, configured, and constructed so that it can be placed onto a hair clipper easily and securely to prevent damage to the clipper blade and/or to the hair clipper.

Another object of the present invention is to provide a blade protector that safeguards the edge and/or teeth of electric and manual hair cutting blades against damage.

Yet another object of the present invention is to provide a cover for a hair clipper that repels moisture from hair clipper blades.

It is still another object of the present invention to provide an adjustable protective cover configured to fit a plurality of hair cutting apparatuses.

In this detailed description, references to "one embodiment", "an embodiment", or "in embodiments" mean that the feature being referred to is included in at least one embodiment of the invention. Moreover, separate references to "one embodiment", "an embodiment", or "embodiments" do not necessarily refer to the same embodiment; however, neither of such embodiments are mutually exclusive, unless so stated, as should be readily apparent to those skilled in the art. Thus, the invention can include any variety of combinations and/or integrations of the embodiments described herein.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the root terms "include" and/or "have", when used in this specification, specify the presence of stated features, steps, operations, elements, and/or components, but do not preclude the presence or addition of at least one other feature, step, operation, element, component, and/or groups thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

For definitional purposes and as used herein "connected", "attached", or "affixed" includes physical, whether direct or indirect, affixed or adjustably mounted, as for example, the blade protector is mounted fixedly to a hair clipper by either directly or through a tab, securing tab, locking or engaging mechanism or other securing means. Thus, unless specified, "connected", "attached", "affixed" or a synonym or variation thereof is intended to embrace any operationally functional connection.

Given the following enabling description of the drawings, the apparatus should become evident to a person of ordinary skill in the art.

DETAILED DESCRIPTION OF THE DRAWINGS

The present invention provides a blade protector configured to prevent damage to a clipper, such as a hair clipper. The blade protector is removeably attachable to a hair clipper, thereby preventing damage to the cutting blades that could be caused, for example, by impact from another object while carrying or by accidental dropping of the hair clipper.

The blade protector may be configured to cover a different kinds of hair clippers. A hair clipper can be any type of hair clipper, such as an electric clipper, manual clipper, trimmer, edger, or tool adapted to cut hair. Further, the blade protector may be designed to cover and protect clippers for various uses, not only hair clippers, but also clippers for cutting animal hair or a clipper for trimming fabric.

According to the present invention, the blade protector may comprise a top portion having an enclosure configured to contain an edge of a hair clipper having a plurality of blades; and a bottom portion including a fastening mechanism for attaching or securing the blade protector onto at least one part of the hair clipper. The enclosure is configured to contain an edge of a hair clipper and thus the plurality of blades of a hair clipper.

The fastening mechanism can be accomplished by removeably attaching, coupling, clamping, connecting, docking, affixing, latching, locking, sliding onto, restraining or securing the blade protector to the hair clipper. In embodiments, the fastening mechanism may comprise at least one tab, clip, lock, lug, bolt, or snap.

The blade protector may be made from any suitable material including, but not limited to, plastic, metal, ceramic, cloth, foam, wood, or any combination thereof. In embodiments, the blade protector may comprise an impact-resistant material, such as a polypropylene material. The blade protector may be designed to have a hard outer shell for the top portion and a soft interior material for the bottom portion. In additional embodiments, the blade protector may comprise a material that is heat-resistant and/or waterproof. The blade protector may be of any desired color.

Figure 1:
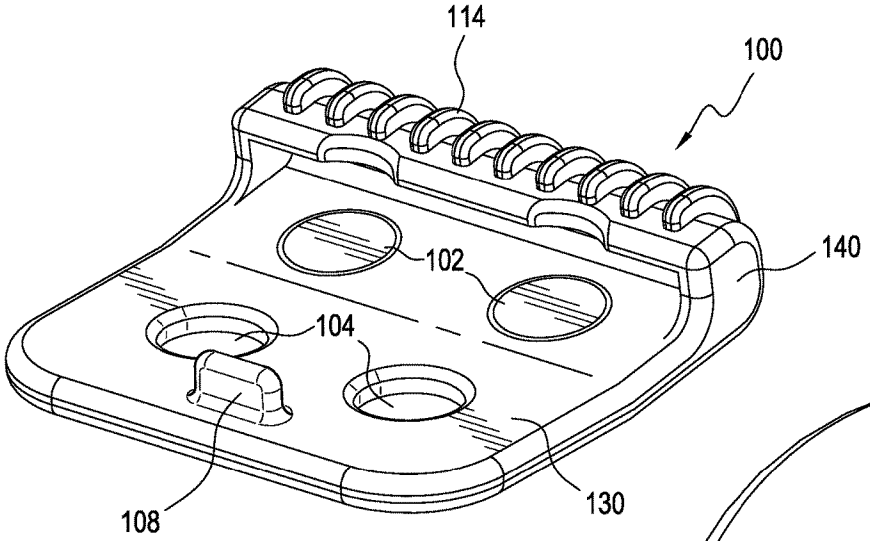
FIG. 1 illustrates a perspective view of a blade protector according to at least one embodiment of the invention.
Figure 3:
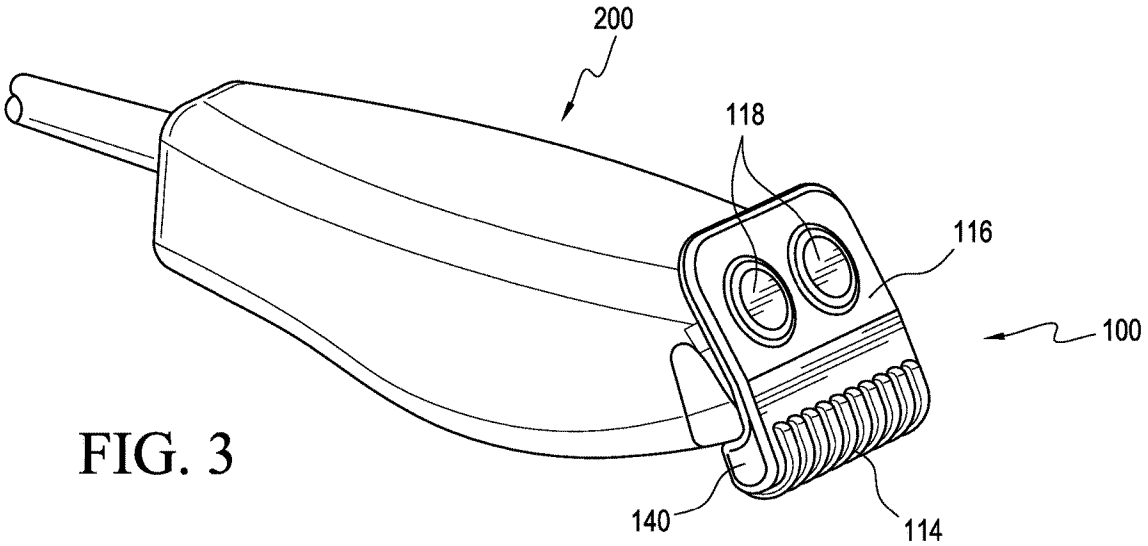
FIG. 3 illustrates a perspective view of a hair clipper and a blade protector according to at least one embodiment of the invention.

As illustrated in FIG. 1, the blade protector 100 comprises a bottom portion or surface 130 (the opposing top portion or surface 116 is illustrated in FIG. 3).

In an embodiment, the blade protector 100 may include at least one magnet 102, for example two or more, that is affixed to an area of the bottom portion 130 to allow the blade protector 100 to be connectively coupled to a portion of a hair clipper, such as a metal outer surface of a hair clipper. In this embodiment, the at least one magnet 102 is illustrated to be in an upper area of the bottom portion 130, but the at least one magnet 102 is not limited in this regard and can be located elsewhere on the bottom portion 130.

The bottom portion 130 may include at least one recessed portion 104, for example, having a concave orientation, and configured to receive at least one protruding member of a hair clipper, such as a screw distended from an outer metal surface of a hair clipper. In this embodiment, the at least one recessed portion 104 is illustrated to be in a lower area of the bottom portion 130 but the at least one recessed portion 104 is not limited in this regard and can be located elsewhere to receive at least one protruding member from a hair clipper.

The bottom portion 130 may include a fastening mechanism, such as a tab 108. The tab 108 is illustrated in the lower area of the bottom portion 130 extending outwardly, but is not limited in this regard. The tab 108 can also be located in any position, such as on a side of the clipper blade. In at least one embodiment of the invention, the tab 108 is configured for preventing the blade protector 100 from sliding forward and off a hair clipper blade.

The blade protector 100 includes an enclosure 140. In a specific embodiment, the enclosure comprises a plurality of projections 114 extending from a surface thereof. Such projections 114 may be located on an outer surface of the enclosure 140 extending from the top portion 116. The projections 114 may be configured to contain an edge of a hair clipper, such as hair clipper blades. In an embodiment, each of the projections 114 is evenly spaced from one another. The projections 114 may include one or more of ridges, folds, shock absorbent fins, or edges, and is not limited to any set number. The projections 114 may be in a parallel or horizontal arrangement or, in one embodiment, may be a single projection.

Figure 2:
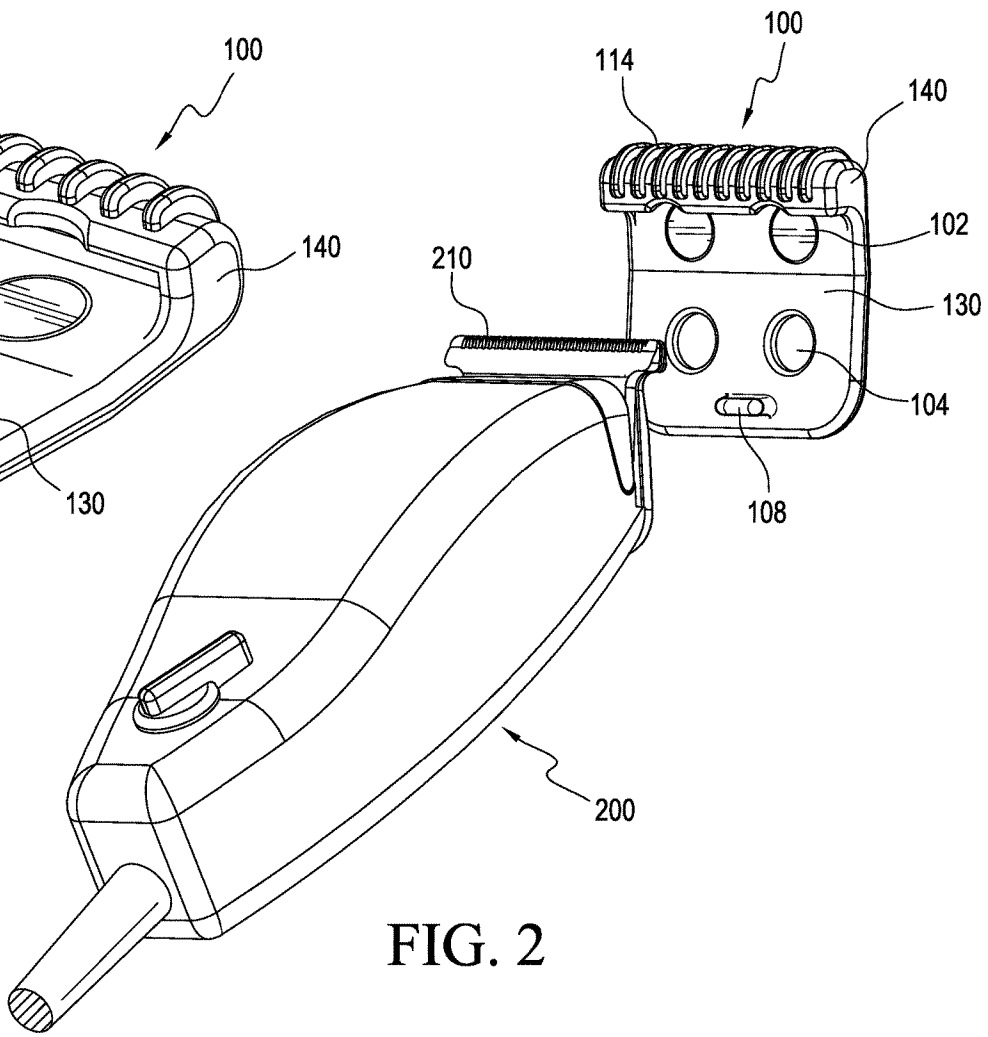
FIG. 2 illustrates an exploded, perspective view of a hair clipper and a blade protector according to at least one embodiment of the invention.

FIG. 2 illustrates the blade protector 100 placed above a hair clipper 200. The blade protector 100 is placed onto a hair clipper blade 210 of the hair clipper 200. The enclosure 140 may be placed on and enclose the hair clipper blade 210. The enclosure 140 includes, but is not limited to, a pocket, guard, guard pocket, shell, or any enclosure configured to contain at least part, or all, of the hair clipper blade 210.

FIG. 3 illustrates the top portion or surface 116 of the blade protector 100 mounted on the hair clipper blade 210 of the hair clipper 200. The top portion 116 may have at least one convex side 118 corresponding to the at least one recessed portion 104. The top portion 116 may be integral with and parallel to the bottom portion 130 of FIG. 1, but can be expanded or narrowed without subtracting from the blade protector's functionality.

Figure 4:
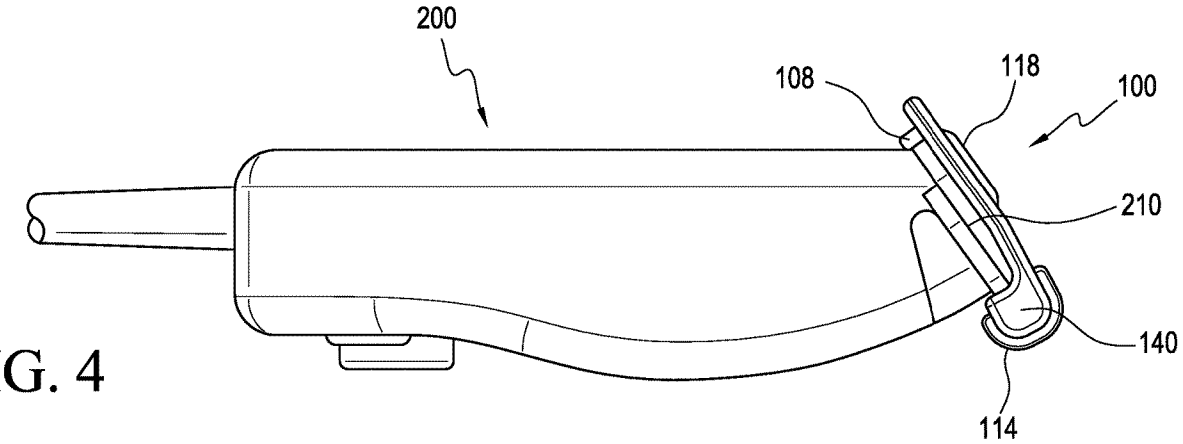
FIG. 4 illustrates a side view of a hair clipper and a blade protector according to at least one embodiment of the invention.

FIG. 4 illustrates a side view of the blade protector 100 mounted on the hair clipper blade 210 of the hair clipper 200. In this embodiment, the blade protector 100 is shown restrained to the hair clipper blade 210, such as by the tab 108 locking onto an edge of the hair clipper blade 210. Also, in this embodiment there is shown the enclosure 140 covering and containing the hair clipper blade 210.

Figure 5:
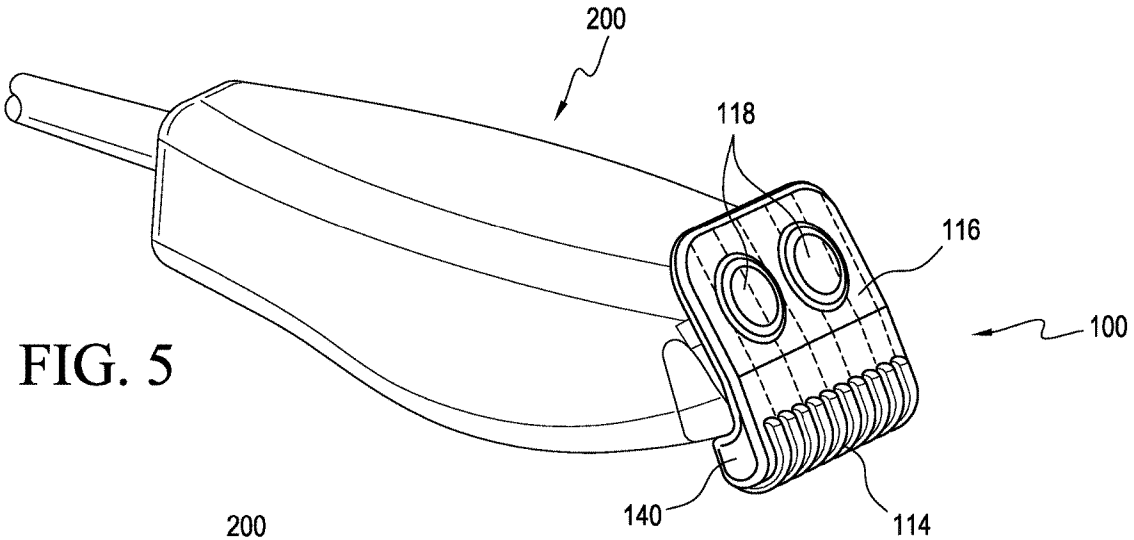
FIG. 5 illustrates a perspective view of a hair clipper and an expandable blade protector according to at least one embodiment of the invention.
Figure 6:
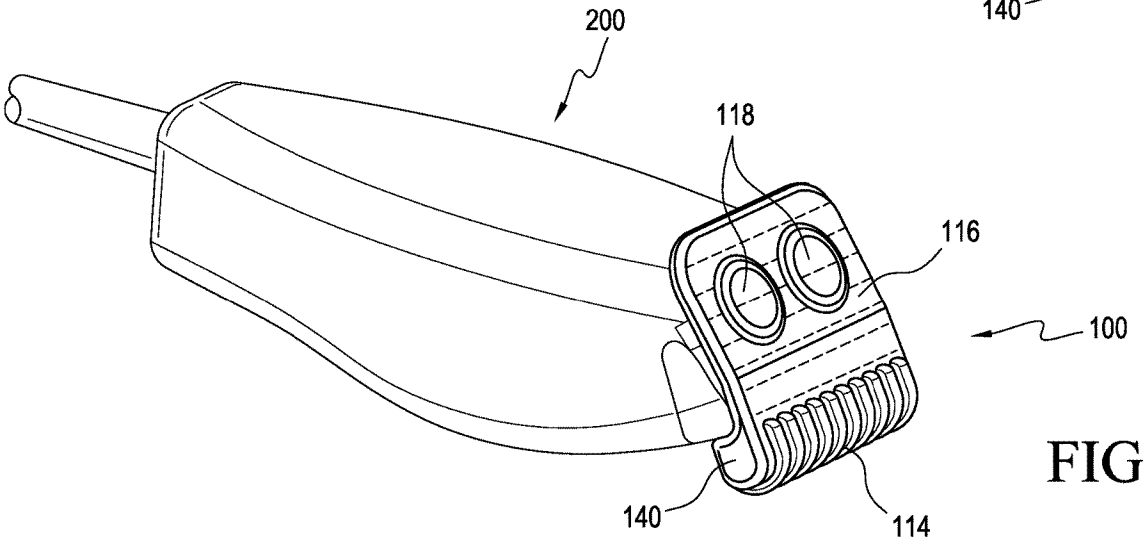
FIG. 6 illustrates a side view of a hair clipper and a telescopeable blade protector according to at least one embodiment of the invention.

FIG. 5 and FIG. 6 illustrate additional embodiments of the blade protector 100. FIG. 5 illustrates the blade protector 100 configured to be expandable or collapsible to slidably enclose at least part of a hair clipper 200, such as by expanding an edge to fit any hair clipper. Vertical dotted lines are depicted to illustrate the capability of the blade protector 100 to expanded or contract a hair clipper blade.

FIG. 6 illustrates the blade protector 100 configured to be telescopeable for expansion or compression for adjustment to slidably enclose at least part of the hair clipper 200, such as by expanding an edge 140 to fit any hair clipper. Horizontal dotted lines are depicted to illustrate the capability of the blade protector 100 to expand or contract on a hair clipper blade.

FIGS. 5-6 illustrate that the blade protector 100 may have an expandable, telescopeable, or collapsible structure. In embodiments, the blade protector may comprise a plurality of overlapping or expandable panels, tiles, gaps, grooves, infolds, or recesses configured to fit a hair clipper blade. Thus, in embodiments, the blade protector 100 may be configured to securely adjust to fit any hair cutting blade.

Figure 7:
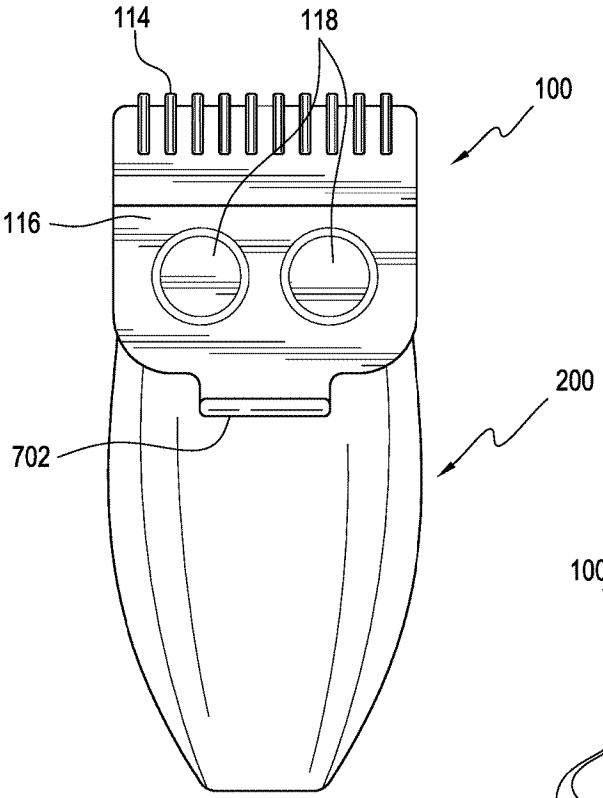
FIG. 7 illustrates a top view of a hair clipper and a blade protector according to at least one embodiment of the invention.

FIG. 7 illustrates top portion 116 of the blade protector 100 mounted onto the hair clipper blade (not illustrated) of the hair clipper 200. In this embodiment, the blade protector has a finger tab 702. The finger tab 702 can be used for mounting or removal of the blade protector 100.

Figure 8:
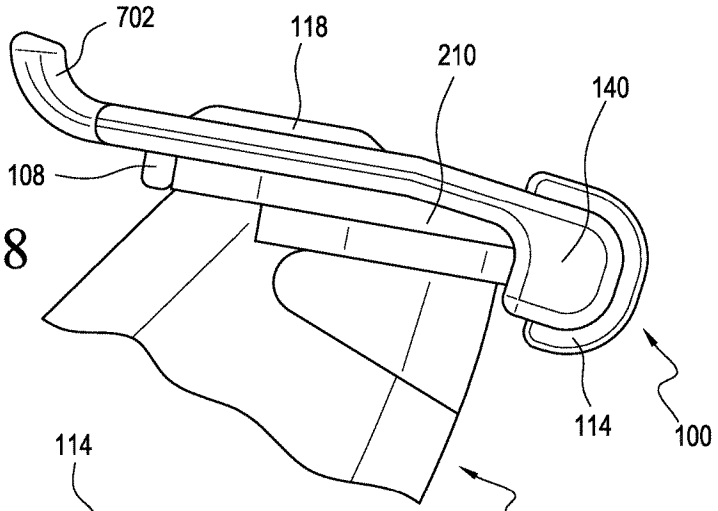
FIG. 8 illustrates a side view of a hair clipper and a blade protector according to at least one embodiment of the invention.

FIG. 8 illustrates a side view of the blade protector 100 mounted on the hair clipper blade 210 of the hair clipper 200. In this embodiment, the blade protector 100 is restrained to the hair clipper blade 210, such as by the tab 108 locking onto an edge of the hair clipper blade 210. Also, finger tab 702 can be used for mounting or removal of the blade protector 100.

Figure 9:
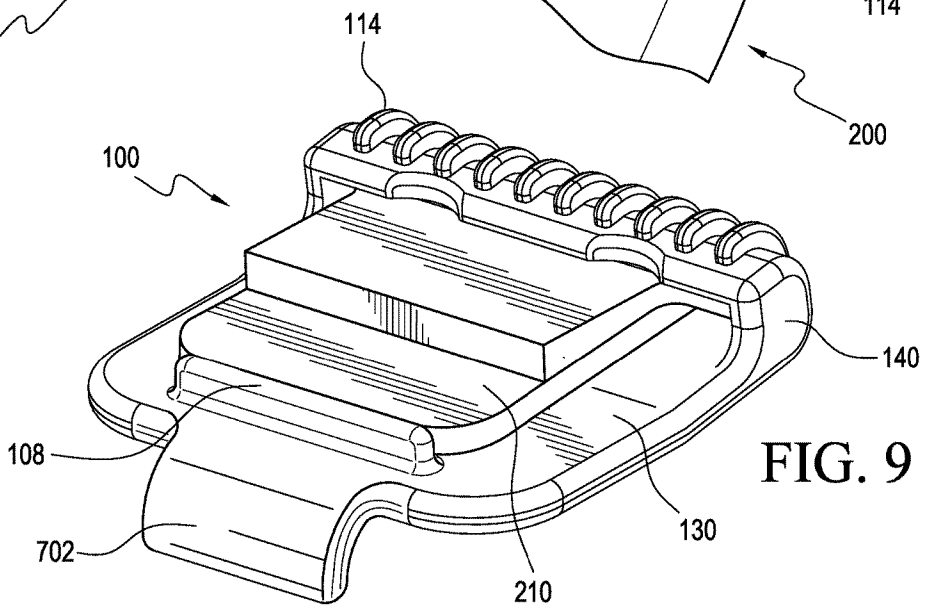
FIG. 9 illustrates a bottom perspective view of a blade protector and an enclosed clipper blade according to at least one embodiment of the invention.

FIG. 9 illustrates a bottom perspective view of the blade protector 100 mounted on a hair clipper blade 210. In this embodiment, the blade protector 100 is restrained to the hair clipper blade 210, such as by the tab 108 locking onto an edge of the hair clipper blade 210. Also, in this embodiment there is a finger tab 702 extending upwardly from the top portion or surface for mounting or removal of the blade protector 100.

Although the present invention has been described in terms of particular examples and alternative embodiments, it is not limited to those embodiments. Alternative embodiments, examples, and modifications which would still be encompassed by the invention may be made by those skilled in the art, particularly in light of the foregoing teachings. The names and descriptions of the apparatus and various referenced parts can be renamed, redefined or changed without departing from the spirit of the invention. Alternate embodiments can also include additional reference numbers or parts such as those illustrated in the drawings but not listed.

The invention claimed is:

1. A blade protector for an electric hair clipper, comprising:

a tab consisting of a single projection positioned between a first side and a second side of the blade protector and on a bottom surface of the blade protector, extending upwardly from the bottom surface of the blade protector, and lockable onto an edge of the electric hair clipper;

at least one magnet on the bottom surface of the blade protector for coupling to a metal surface of the electric hair clipper;

at least one recessed portion on the bottom surface of the blade protector configured to receive a screw located on the metal surface of the electric hair clipper;

an enclosure extending along an entire side of the blade protector and configured to fully cover cutting edges of the electric hair clipper; and a plurality of projections extending outwardly from and substantially along an outer surface of the enclosure, said plurality of projections being perpendicular to a longitudinal length of said enclosure.

2. The blade protector of claim 1, having two recessed portions on the bottom surface of the blade protector configured to respectively receive two screws located on the metal surface of the electric hair clipper.

3. The blade protector of claim 1, wherein the projections are evenly spaced substantially along the longitudinal length of the outer surface of the enclosure.

4. The blade protector of claim 1, wherein the blade protector comprises plastic, metal, or any combination thereof.

5. The blade protector of claim 1, wherein the blade protector comprises a polypropylene material.

6. The blade protector of claim 1, wherein the tab is positioned midway between the first side and the second side of the bottom surface.

7. The blade protector of claim 1, wherein the tab is positioned between the first side and the second side of the bottom surface, opposite the enclosure.

8. The blade protector of claim 1, wherein the single projection extends perpendicularly from the bottom surface of the blade protector and has a height so that, when the blade protector is locked onto the electric hair clipper, a top of said single projection is flush with a surface of the electric hair clipper.

9. The blade protector of claim 1, wherein the enclosure has side walls, thereby covering an entirety the electric hair clipper blade.

* * * * *